US006652338B2

(12) United States Patent
Takahashi

(10) Patent No.: US 6,652,338 B2
(45) Date of Patent: Nov. 25, 2003

(54) LUBRICANT DRAIN ARRANGEMENT FOR MULTI-CYLINDER INTERNAL COMBUSTION ENGINE

(75) Inventor: Masanori Takahashi, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/234,018

(22) Filed: Aug. 29, 2002

(65) Prior Publication Data

US 2003/0064643 A1 Apr. 3, 2003

(30) Foreign Application Priority Data

Aug. 29, 2001 (JP) ..... 2001-260082

(51) Int. Cl.[7] ..... B63H 21/10
(52) U.S. Cl. ..... 440/88 R; 440/88 L; 123/196 R
(58) Field of Search ..... 123/196 R, 196 CP, 123/196 M, 198 DA; 440/88 R, 88 L

(56) References Cited

U.S. PATENT DOCUMENTS

| | | | | |
|---|---|---|---|---|
| 5,072,809 A | * | 12/1991 | Shibata | 184/6.13 |
| 5,215,164 A | * | 6/1993 | Shibata | 184/6.13 |
| 5,687,686 A | | 11/1997 | Takahashi | |
| 5,752,866 A | | 5/1998 | Takahashi et al. | |
| 5,778,848 A | | 7/1998 | Takahashi et al. | |
| 5,997,372 A | * | 12/1999 | Idzikowski et al. | 440/88 L |
| 6,076,495 A | | 6/2000 | Takahashi et al. | |
| 6,099,374 A | | 8/2000 | Watanabe et al. | |
| 6,138,634 A | * | 10/2000 | Kusche et al. | 123/196 R |
| 6,286,476 B1 | | 9/2001 | Hiraoka et al. | |
| 6,325,037 B1 | | 12/2001 | Takahashi et al. | |

FOREIGN PATENT DOCUMENTS

| | | |
|---|---|---|
| JP | 09-256904 | 9/1997 |

* cited by examiner

*Primary Examiner*—Stephen Avila
(74) *Attorney, Agent, or Firm*—Knobbe Martens Olson & Bear LLP

(57) ABSTRACT

A lubricant drain arrangement for a multi-cylinder internal combustion engine having an engine body defining a plurality of cylinder bores and including a cylinder block and a crankcase member. The cylinder block and the crankcase member define a crankcase chamber. The crankcase chamber houses a generally vertically-extending crankshaft and includes a forward wall and a rearward wall on opposing sides of the crankshaft. A recess extends beyond one of the forward wall and the rearward wall and communicates with a lubricant drain passage. The lubricant drain passage extends in a generally vertical direction and passes through the engine body to permit lubricant to be evacuated from the crankcase chamber. In one arrangement, the recess and drain passage are formed in the cylinder block. A plurality of paired crankshaft supports are provided within the crankcase chamber and extend from opposing walls of the crankcase member and the cylinder block. A plurality of apertures are formed through the supports and a lower wall of the cylinder block. A plug closes the aperture of the lower wall of the cylinder block. A lubricant drain conduit communicates with the aperture of the lower wall to evacuate lubricant from the crankcase chamber. A lubricant guide channel extends between the lowermost cylinder bore and the aperture of the lower wall and/or the lubricant drain conduit to inhibit pooling of lubricant within the lowermost cylinder bore.

17 Claims, 7 Drawing Sheets

LUBRICANT DRAIN ARRANGEMENT FOR MULTI-CYLINDER INTERNAL COMBUSTION ENGINE

RELATED APPLICATION

This application is related to, and claims priority from, Japanese Patent Application No. 2001-260082, filed on Aug. 29, 2001, the entire contents of which are hereby expressly incorporated by reference.

BACKGROUND OF THE INVENTION

1. Field of the Invention

The present invention generally relates to lubrication systems of outboard motors for watercraft. In particular, the present invention relates to an improved lubricant drain arrangement for a multi-cylinder internal combustion engine.

2. Description of the Related Art

Outboard motors containing internal combustion engines are commonly used for powering watercraft. A housing is mounted to a transom of the watercraft and typically encloses the engine. Rotation of a crankshaft of the internal combustion engine drives a driveshaft, which, in turn, drives a water propulsion device, such as a propeller. During normal operation of the watercraft, the propeller is submerged beneath a water surface. Rotation of the propeller moves the watercraft across the water surface.

Many internal combustion engines contained with an outboard motor include multiple cylinders and operate on a four-stroke combustion cycle. The four-stroke combustion cycle is well known to those of skill in the art and, therefore, will not be explained in detail herein. Four-stroke engines commonly comprise a crankcase in which the crankshaft is housed. Typically, in an outboard motor, the crankshaft assumes a generally vertical orientation. A cylinder block extends generally horizontally from the crankcase. The cylinder block defines multiple cylinder bores, each of which define a generally horizontal axis. A cylinder head member is affixed to the cylinder block to close the ends of the cylinder bores and, along with pistons, define combustion chambers of the internal combustion engine.

Internal combustion engines generally require lubricant for normal operation. Four-cycle engines typically employ a recirculating type of lubrication system. In such a system, a lubricant pump supplies lubricant to various moving components of the engine, including components within the crankcase chamber. Lubricant is evacuated from the crankcase chamber and returns to the lubricant reservoir, which is typically mounted below the crankcase chamber. Thus, drainage of the lubricant from the crankcase chamber to the lubricant reservoir is essential to ensure that a sufficient level of lubricant is made available to the lubricant pump for further distribution throughout the internal combustion engine.

An example of a typical lubricant drain arrangement is illustrated within the crankcase member shown in FIG. 1. The crankcase member illustrated in FIG. 1, along with additional details of an associated engine, may be found in Japanese Patent Application Publication No. JP-A-9-256904.

The crankcase member 10 illustrated in FIG. 1 is generally semi-cylindrical, or bowl-shaped, and defines an essentially hollow interior space. The crankcase member 10 is adapted to be connected to a cylinder block of an internal combustion engine at a peripheral mating surface 12 by a plurality of fasteners, such as bolts, which pass through a plurality of apertures 14 and thread into the cylinder block of the internal combustion engine. The crankcase member 10 and the cylinder block cooperate to define a crankcase chamber, which houses the crankshaft of the internal combustion engine.

The crankshaft is supported by a plurality of bearing surfaces 16 defined by upper and lower end walls of the crankcase member 10 and by one or more supports 18, which are intermediate to the upper and lower wall portions of the crankcase member 10 and divide the crankcase chamber into a plurality of sections. The supports 18 are generally provided to support the crankshaft and are located at a position between each cylinder bore. Accordingly, each section of the crankcase chamber is associated with an individual cylinder bore. The supports 18 also provide rigidity to the crankcase member 10 and thus absorb forces transmitted to the crankshaft due to combustion within the combustion chambers of the internal combustion engine.

A pair of lubricant drain passages 20 pass through the supports 18 and through a lower end of the crankcase member 10 to permit lubricant to drain from the crankcase chamber and, eventually, return to the lubricant reservoir. A thin-walled support, or rib 22, is provided along one side of the lubricant passage 20 within each section of the crankcase chamber. The ribs 22 act to restore lost strength and rigidity of the crankcase member 10 due to the formation of the lubricant passages 20 through the supports 18. The ribs 22 may also be arranged to guide lubricant, which is flung from the crankshaft, into the lubricant passage 20.

SUMMARY OF THE INVENTION

An aspect of the present invention is the discovery that, with the lubricant drain arrangement as illustrated in FIG. 1, lubricant may become trapped on a side of the rib 22 opposite the lubricant drain passage 20. Trapped lubricant tends to degrade due to elevated temperatures within the crankcase chamber and, once compromised, may not effectively lubricate the moving parts of the internal combustion engine. Additionally, trapped lubricant may enter the cylinder bore where it may pass by the piston rings and into the combustion chamber. Lubricant passing into the combustion chamber is then burned, and results in undesirable emissions from the engine. Accordingly, preferred embodiments of the present invention incorporate a lubricant drain passage that is recessed from an inner wall of the crankcase chamber. Such an arrangement preserves the strength of the components of the engine comprising the crankcase chamber and inhibits lubricant from becoming trapped within the crankcase chamber.

Another aspect of the present invention involves an outboard motor including an internal combustion engine and a propulsion device. A lubrication system is configured to deliver lubricant to a portion of the engine. The engine has a crankshaft arranged in a generally vertical manner and a driveshaft connects the crankshaft to the propulsion device. The engine includes a cylinder block and a crankcase. The cylinder block defines a plurality of cylinder bores, each cylinder bore defining a generally horizontal axis and being spaced from one another in a vertical direction. The cylinder block has a first wall generally aligned with the first end of the cylinder bores nearest the crankshaft. The cylinder skirt extends generally from a periphery of the first wall and terminates in the first mating surface. The crankcase includes a second wall, a second mating surface, and a peripheral wall extending between the second wall and the second mating surface. The cylinder blocks in the crankcase are assembled such that the first mating surface faces the second mating surface and the cylinder block and crankcase define a crankcase chamber therebetween. A plurality of support members extend from the first wall and the second wall in a paired configuration and terminate in cooperating bearing surfaces to rotatably support the crankshaft. A recess is defined by one of the cylinder block and the crankcase and extends beyond one of the first wall and the second wall, away from the crankcase chamber. An oil drain passage communicates with the recess and extends in a downward direction past the plurality of support members and through a lower end of one of the cylinder skirt and the peripheral wall.

A further aspect of the present invention involves an outboard motor including an internal combustion engine and a propulsion device. A lubrication system is configured to deliver lubricant to a portion of the engine. The engine has a crankshaft arranged in a generally vertical manner and a driveshaft connecting the crankshaft to the propulsion device. The engine includes a cylinder block and a crankcase. The cylinder block defines a plurality of cylinder bores, each cylinder bore defining a generally horizontal axis and being spaced from one another in a vertical direction. The cylinder block has a first wall generally aligned with a first end of the cylinder bores, nearest the crankshaft. A cylinder skirt extends generally from a periphery of the first wall and terminates in a first mating surface. The crankcase includes a second wall, a second mating surface and a peripheral wall extending between the second wall and the second mating surface. The cylinder block and the crankcase are assembled such that the first mating surface faces the second mating surface and a cylinder block in the crankcase define a crankcase chamber therebetween. A plurality of support members extend from the first wall and the second wall in a paired configuration and terminate in cooperating bearing surfaces to rotatably support the crankshaft. A plurality of apertures extend through the plurality of support members of the cylinder block and a lower end of the cylinder skirt. The apertures are aligned along a common axis and a plug closes the aperture of the cylinder skirt. An oil guide passage communicates with the lower-most of the cylinder bores and the aperture of the cylinder skirt. An oil drain passage communicates with the oil guide passage and extends through the cylinder block to permit lubricant to be evacuated from the crankcase chamber.

Yet another aspect of the present inventions involves an internal combustion engine. A lubrication system is configured to deliver lubricant to a portion of the engine. The engine has a crankshaft arranged in a generally vertical manner and includes an engine body defining a plurality of cylinder bores and a crankcase chamber. Each cylinder bore defines a generally horizontal axis and is spaced from one another in a vertical direction. The crankshaft chamber has a pair of opposing walls, one of the walls being between the crankshaft and the cylinder bores. A plurality of support members extend from the opposing walls in a pair to configuration and terminate and cooperating, bearing surfaces to rotatably support the crankshaft. A recess is defined by the engine body and extends beyond one of the opposing walls away from the crankshaft. The recess defines an oil drain passage extending in a downward direction to a lower end of the engine body.

Still a further aspect of the present invention involves an internal combustion engine. A lubrication system is configured to deliver lubricant to a portion of the engine. The engine has a crankshaft defining a generally vertical crankshaft axis and includes an engine body defining a plurality of cylinder bores and a crankcase chamber. Each cylinder bore defines a generally horizontal axis and are spaced from one another in a vertical direction. The crankshaft chamber has a pair of opposing walls, one of the walls being between the crankshaft and the cylinder bores. A plurality of support members extend from the opposing walls in a paired configuration and terminate in cooperating bearing surfaces to rotatably support the crankshaft. A plurality of apertures extend through the plurality of support members between the crankshaft and the cylinder bores and a lower end of the engine body. The apertures are aligned along a common axis and a plug closes the aperture of the engine body. An oil drain arrangement communicates with a lowermost of the cylinder bores and the aperture of the engine body. The oil drain arrangement extends through the engine body to permit lubricant to be evacuated from the crankcase chamber.

BRIEF DESCRIPTION OF THE DRAWINGS

These and other features, aspects and advantages of the present invention will now be described in detail with reference to drawings of a preferred embodiment, which are intended to illustrate and not to limit the present invention. The drawings contain seven figures.

DETAILED DESCRIPTION OF THE PREFERRED EMBODIMENT

Figure 2:
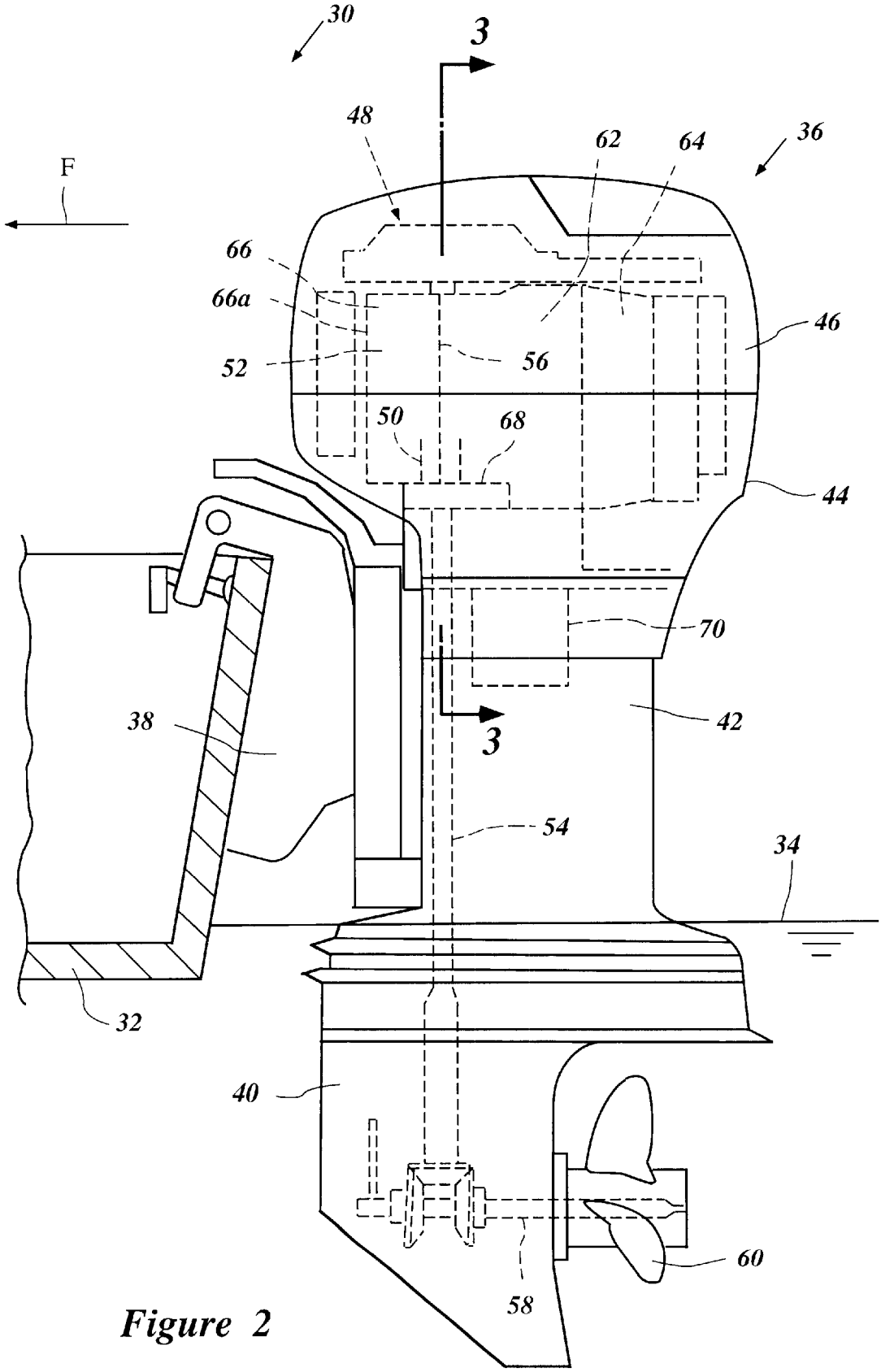
FIG. 2 is a side elevational view of an outboard motor constructed in accordance with a preferred embodiment of the present lubricant drain arrangement, with certain features including an engine, driveshaft and transmission shown in phantom. The engine includes a cylinder block and a crankcase member.

With reference to FIG. 2, an outboard motor is described in general detail. This description is provided to assist the reader's understanding of a preferred environment of use for the present lubricant drain arrangement for a multi-cylinder internal combustion engine. However, as those of skill in the art will appreciate, the present lubricant drain arrangement described below can be used in other vehicles, such as, for example, but without limitation, personal watercraft and jet boats. Additionally, the outboard motor is described with reference to a coordinate system wherein a longitudinal axis extends from fore to aft and a lateral axis extends from port side to starboard side, normal to the longitudinal axis. In addition, relative heights are expressed as elevations in reference to the undersurface of the associated watercraft. In various figures, an arrow labeled "F" points along the longitudinal axis and indicates a forward direction of travel for the watercraft.

FIG. 2 illustrates a watercraft 30 comprising a hull 32 floating on a water surface 34 and including an outboard motor 36. A clamping bracket 38 secures the outboard motor 36 to the hull 32.

A casing houses the components of the outboard motor 36. The casing includes a lower portion 40, which is submerged beneath the water surface 34, an intermediate portion 42 extending generally vertically from the lower portion 40, and an upper portion 44 extending generally vertically from the intermediate portion 42.

The upper portion 44 comprises a cowling 46, which is typically constructed of a sturdy plastic. The cowling 46 contains an internal combustion engine 48, which generates power to propel the watercraft 30 across the water surface 34. In the illustrated embodiment, the engine 48 includes four cylinders and operates on a four-stroke combustion cycle.

The engine 48 turns a crankshaft 50, which is supported within a crankcase chamber 52. The crankshaft 50, in turn, rotates a vertically extending driveshaft 54. The driveshaft 54, having an axis of rotation 56, extends from the upper portion 44, through the intermediate portion 42 and into the lower portion 40. A lower end of the driveshaft 54 is operably connected to a propeller shaft 58, which rotates with the driveshaft 54. The propeller shaft 58 extends generally parallel to the water surface 24 and includes a propeller 60 mounted to an aft end thereof. The propeller 60 rotates with the propeller shaft 58, generating a force on the water. The reaction force of the water upon the propeller 60 propels the watercraft 30 across the water surface 34.

The engine 48 includes an engine body, which is generally comprised of a cylinder block 62, a cylinder head 64 and a crankcase member 66. The cylinder block 62 is preferably constructed of a cast aluminum and defines a plurality of cylinder bores. However, as will be appreciated by one of skill in the art, the cylinder block 62 may be constructed of a variety of other suitable materials and/or construction methods.

The cylinder head 64 is affixed to one end of the cylinder block 62 closing one end of the cylinder bores and, along with pistons, defining combustion chambers of the engine 48, which is described in greater detail below. Like the cylinder block 62, the cylinder head 64 is preferably constructed of a die-cast aluminum. However, other suitable materials and manufacturing processes may also be used.

The crankcase member 66 is generally semi-cylindrical, or bowl-shaped, and is fixed to an end of the cylinder block 62 opposite the cylinder head 64. The crankcase member 66, along with a lower portion of the cylinder block 62, defines the crankcase chamber 52, which rotatably supports the crankshaft 50.

The outboard motor 36 also includes a lubricant pump 68, which is configured to supply lubricant to portions of the engine 48 that benefit from lubrication, such as, for example, but without limitation, crankshaft bearings, cylinder walls, piston pins, and valve train components. Preferably, the lubricant pump 68 is a trochoid-type pump, however, other suitable types of pumps may also be used.

Preferably, a lubricant reservoir 70 contains a supply of lubricant, which is made available to the lubricant pump 68. Desirably, the lubricant reservoir 70 is mounted at a height below the lubricant pump 68 and the engine 48. Lubricant that is supplied to the engine 48 by the lubricant pump 68 then returns, under the influence of gravity, through various passages to the lubricant reservoir 70 to be made available to the lubricant pump 68 for recirculation throughout the engine 48.

Figure 3:
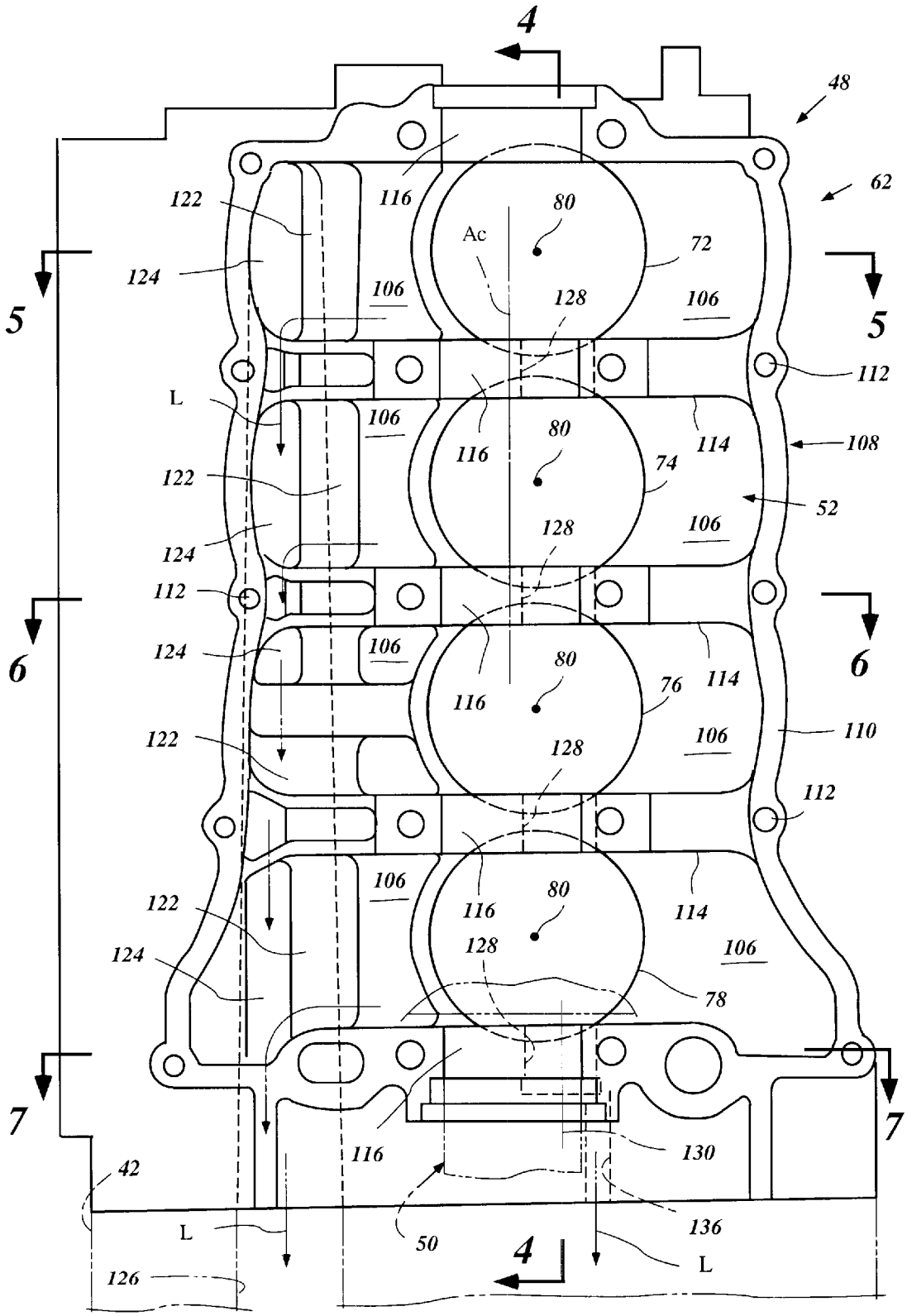
FIG. 3 is a front elevational view of the cylinder block of the engine taken along the view line 3—3 of FIG. 2 and having the crankcase member of the engine removed.
Figure 4:
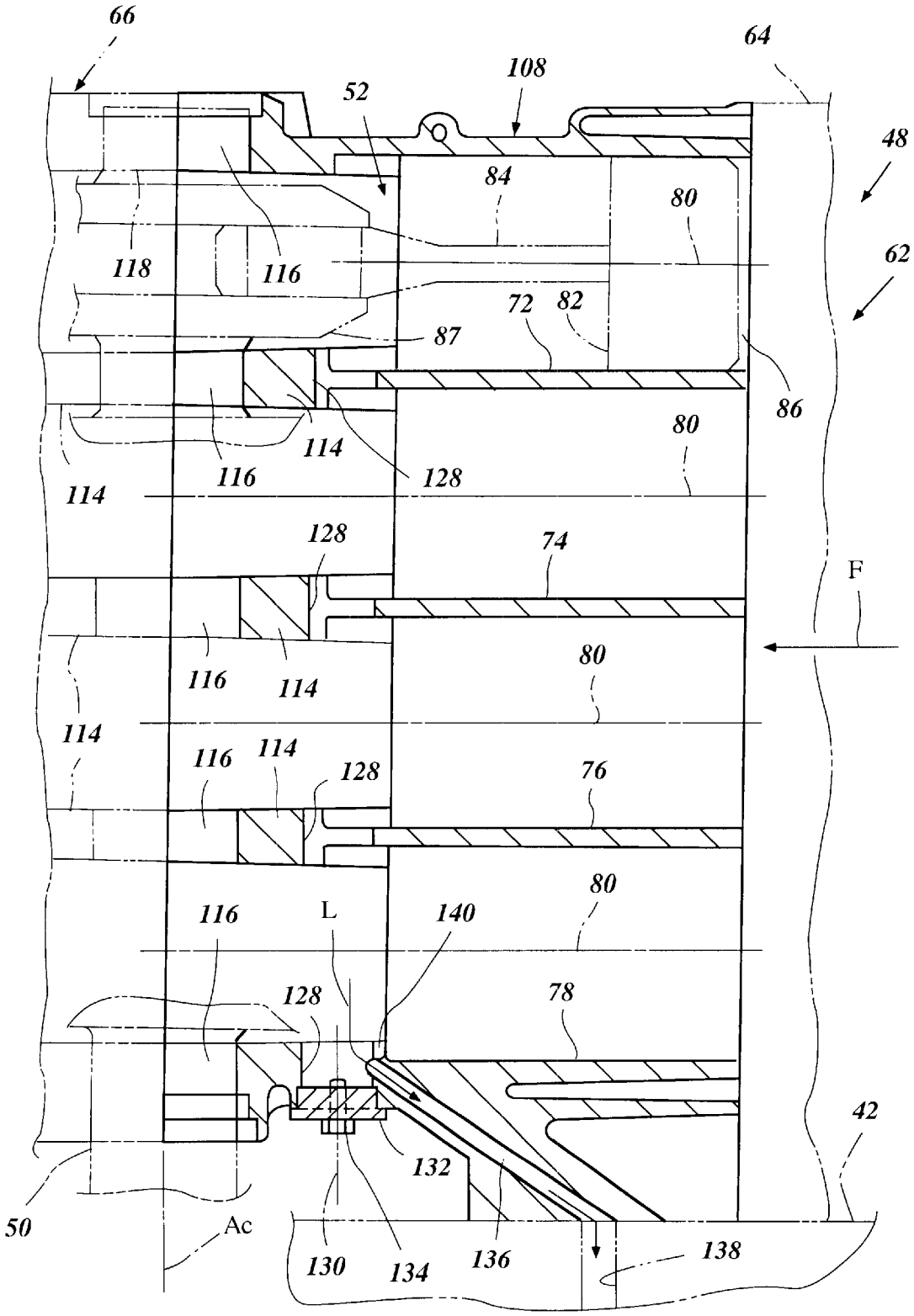
FIG. 4 is a cross-sectional view of the engine of FIG. 2 taken along the view line 4—4 of the FIG. 3.
Figure 5:
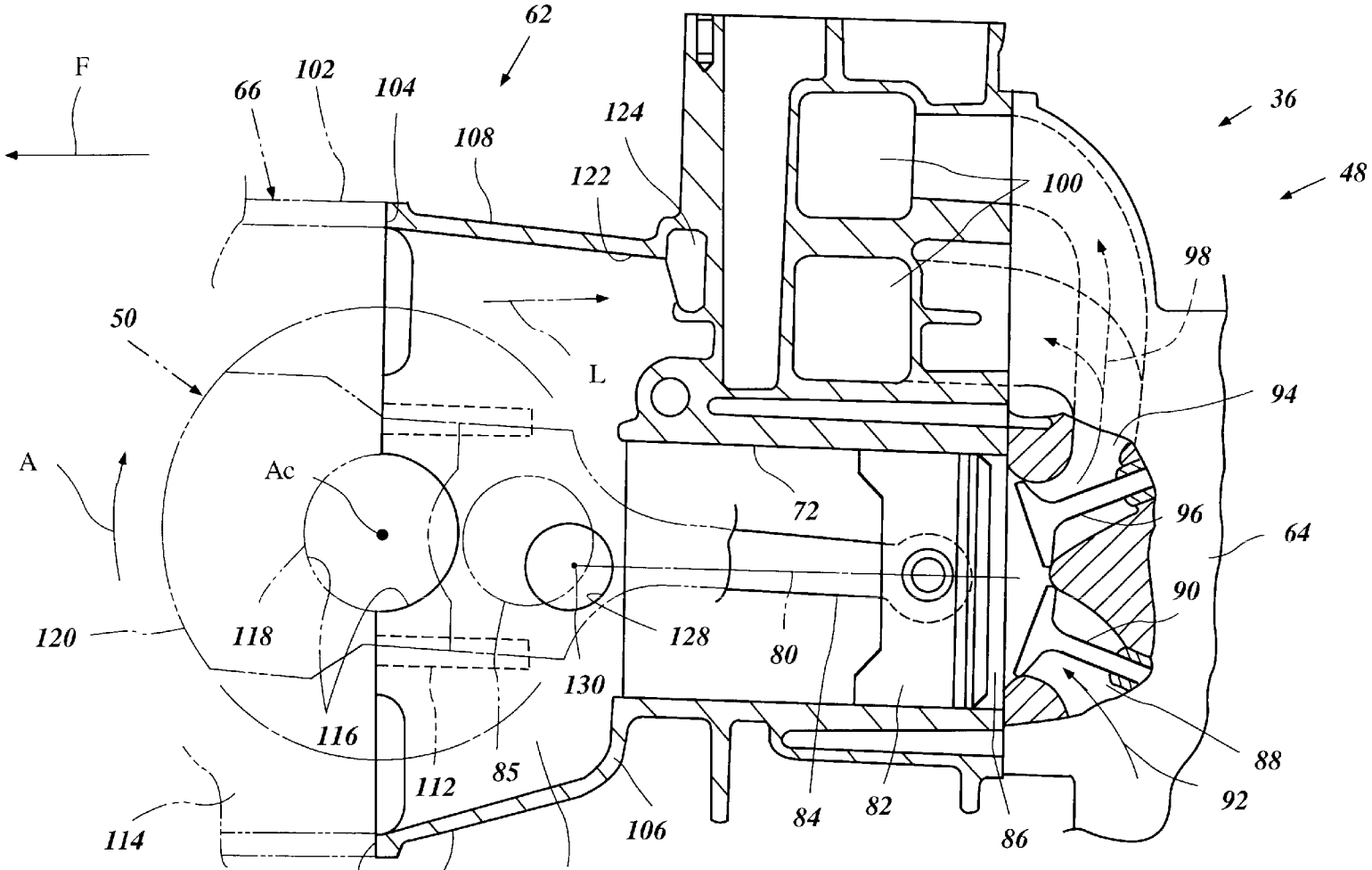
FIG. 5 is a cross-sectional view of the engine of FIG. 2 taken along the view line 5—5 of FIG. 3.
Figure 6:
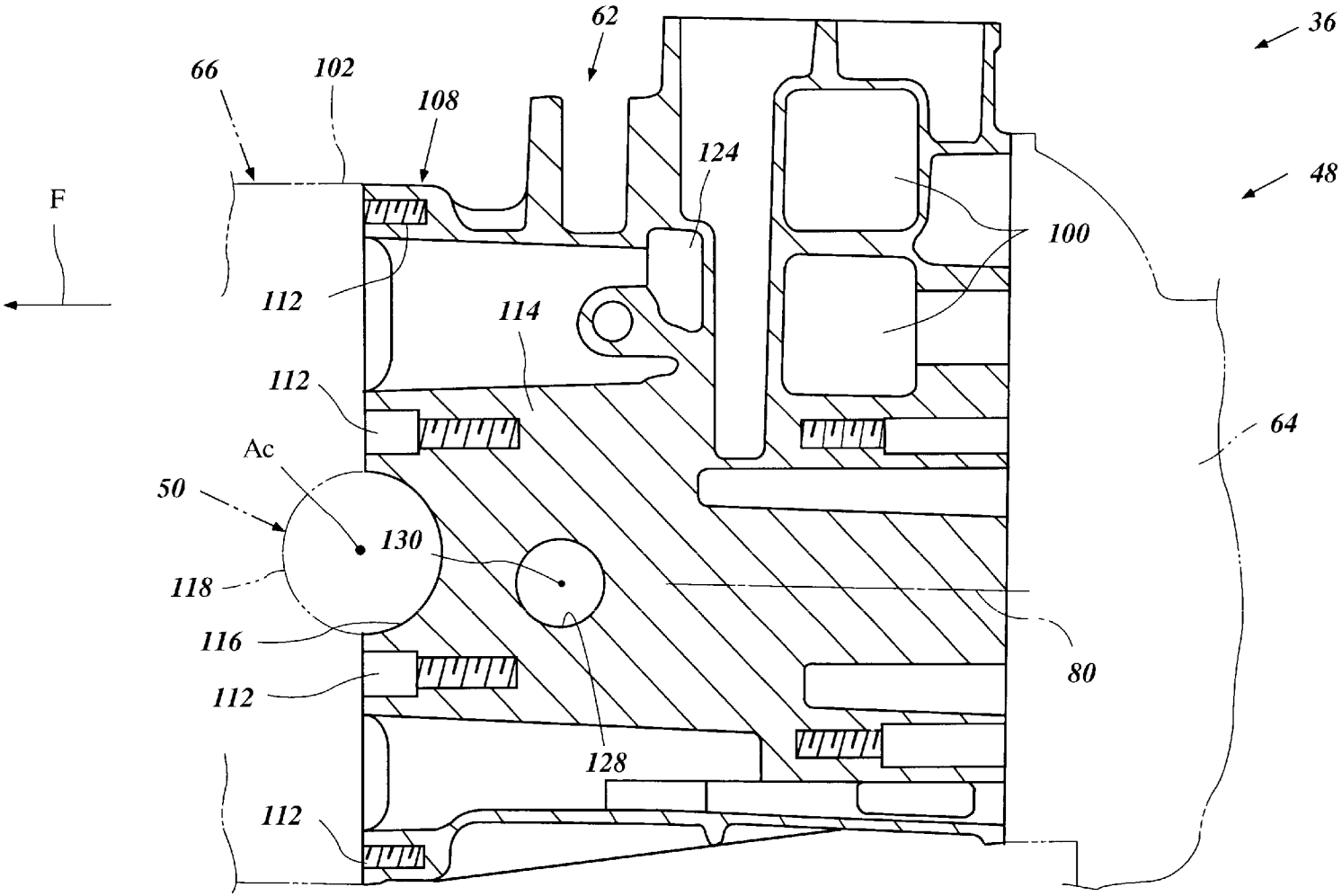
FIG. 6 is a cross-sectional view of the engine of FIG. 2 taken along the view line 6—6 of FIG. 3.
Figure 7:
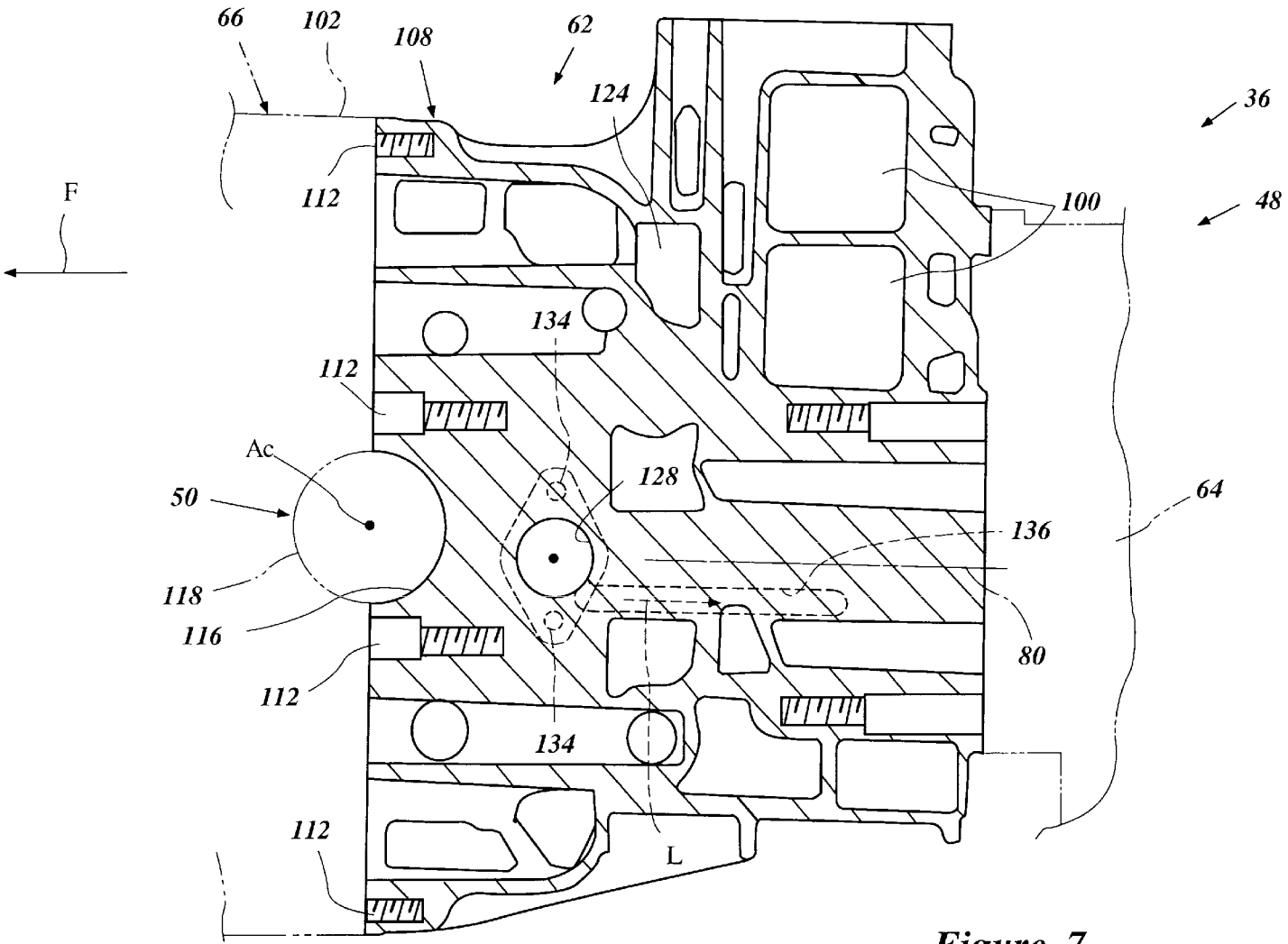
FIG. 7 is a cross-sectional view of the engine of FIG. 2 taken along the view line 7-2 of FIG. 3.

With reference to FIGS. 3–5, the internal combustion engine 48 is described in greater detail. As described above, the illustrated cylinder block 62 defines four cylinder bores, or cylinders, 72, 74, 76, 78. Preferably, the cylinders 72, 74, 76, 78 are arranged vertically, and are preferably equally spaced from one another in the vertical direction. However, the engine may alternatively comprise a different number of cylinder bores and/or comprise other orientations of the cylinder bores, such as being inclined with respect to one another, for example.

The uppermost cylinder 72 will be referred to herein as the first cylinder, the next uppermost cylinder 74 will be referred to as the second cylinder, the next uppermost cylinder 76 will be referred to as the third cylinder, and the lowermost cylinder 78 will be referred to as the fourth cylinder. A longitudinal axis 80 of each cylinder 72, 74, 76, 78 extends generally in the direction of the longitudinal axis of the watercraft 30. Each cylinder 72, 74, 76, 78 houses a piston 82 (only one shown in FIG. 4), which is slideable within the cylinder 72, 74, 76, 78 along the cylinder axis 80.

The pistons 82 reciprocate within their respective cylinders 72, 74, 76, 78 in response to the combustion reactions in each cylinder 72, 74, 76, 78. A piston rod 84 connects each piston 82 to a crank pin 85 of a throw 87 (FIG. 4) of the crankshaft 50. The reciprocating motion of the pistons 82 turns the crankshaft 50, which turns the vertically extending driveshaft 54, as described above.

A spaced defined between the cylinder head 64 and the piston 82 in each cylinder defines a combustion chamber 86. Each combustion chamber 86 includes an associated intake port 88, which is formed in the cylinder head 64. An intake valve 90 selectively opens and closes each intake port 88, enabling air-fuel charges 92 to enter the combustion chamber 86 during the intake stroke. Further, each combustion chamber 86 also includes an associated exhaust port 94, which is also formed in the cylinder head 64. An exhaust valve 96 selectively opens and closes each exhaust port 94, enabling the exhaust gases 98 to exit the combustion chamber 86 during the exhaust stroke. The opening and closing of the intake and exhaust valves 90, 96 is synchronized with rotation of the crankshaft 50 through a valve drivetrain arrangement, as is well known in the art.

Each exhaust port 94 expels the exhaust gases 98 into an associated exhaust passages 100. In the illustrated embodiment, two exhaust passages 100 are provided, each associated with two of the combustion chambers 86. The illustrated ports 94 are curved, substantially U-shaped, tubular passages extending from the combustion chamber 86, through the passages 100 and to an exhaust conduit arrangement (not shown) of the engine 48. Each exhaust port 94 is preferably the same size, such that a gas path through each exhaust port 94 is the same length. An exhaust conduit arrangement preferably extends through the intermediate and lower portions 42, 40 of the casing and expel exhaust gases 98 into the ambient water through an opening (not shown) in the casing lower portion 40. In addition, a portion of the exhaust gases 98 may be expelled, through a separate discharge, above the water surface 34 during certain operating conditions of the engine 48, such as at idle speeds, for example.

As described above, the crankcase chamber 52 is defined by the crankcase member 66 and the cylinder block 62. The crankcase member 66 is generally semi-cylindrical, or bowl-shaped, and includes a peripheral wall 102, which extends from a forward end wall **66*a* (FIG. 2) and terminates in a mating surface 104**.

The cylinder block 62 includes a rearward wall 106 (FIGS. 3 and 5), which is generally coplanar within an end of the cylinder bores 76 nearest the crankshaft 50. A peripheral wall, or cylinder skirt 108, extends in a forward direction from the rearward wall 106 and terminates in a mating surface 110, which is sized and shaped to mate with the mating surface 104 of the crankcase member 66. The crankcase member 66 and the cylinder block 62 may be secured to one another by a plurality of threaded fasteners engaging threaded cavities 112 of the cylinder block 62 such that the mating surfaces 104, 110 face one another.

Both the crankcase member 66 and the cylinder block 62 include a plurality of crankshaft support portions 114 extending from the forward wall 66*a* and rearward wall 106, respectively. The supports 114 of the crankcase member 66 and the cylinder block 62 are aligned with one another in a paired configuration and divide the crankcase chamber 52 into a plurality of sections, each section being associated with a respective cylinder bore 72, 74, 76, 78.

Each of the supports 114 define a bearing surface 116 at its terminal end that, together, are configured to rotatably support the crankshaft 50. In addition, each of the upper walls of each of the crankcase member 66 and the cylinder block 62, which together define an upper wall of the crankcase chamber 52, also include a bearing surface 116. Similarly, the lower walls of each of the crankcase member 66 and the cylinder block 62, which together define a lower wall of the crankcase chamber 52, also include a bearing surface 116.

With reference to FIGS. 4 and 5, the crankshaft 50 comprises a main crankshaft portion 118, which is interrupted by the throws 87 of the crankshaft 50. The throws 87 support an end of the connecting rod 84 opposite the piston 82 at a location spaced from the axis of rotation $A_C$ of the crankshaft 50, thus converting the reciprocating motion of the piston 82 into rotation of the crankshaft 50. The throws 87 of the crankshaft 50 are positioned in each section of the crankcase 52 defined by the supports 114.

As described above, the lubricant pump 68 delivers a flow of lubricant L from the lubricant reservoir 70 to moving parts of the engine 48, including the bearing portions of the crankshaft 50 and bearings of the crankshaft end of the connecting rod 84. The lubricant may be delivered to these locations through a passage formed within the crankshaft 50, as is known in the art. Lubricant provided to the crankcase chamber 52 is then returned to the lubricant reservoir to be redelivered by the lubricant pump 68 in a continuous cycle.

With reference to FIGS. 3–7, a preferred lubricant drain arrangement is described in detail. Advantageously, the present lubricant drain arrangement permits effective draining of the lubricant L from each section of the crankcase chamber 52 while reducing the tendency to trap the lubricant within the crankcase chamber 52, where it may deteriorate due to excessive heat.

Desirably, a recess 122 extends beyond an interior surface of the rearward wall 106 of the cylinder block 62. In the illustrated embodiment, the recess 122 is interrupted by each support 114 of the cylinder block 62, thereby defining individual recess portions within each section of the crankcase chamber 52.

A lubricant drain passage 124 communicates with the recess 122 and extends vertically through a portion of the cylinder block 62 and through the lower wall of the cylinder block 62. Preferably, the oil drain passage 124 communicates with a rearward end of the recess 122 and is spaced from each support 114. The oil drain passage 124 communicates with a lubricant return conduit 126 at its lower end, which returns the lubricant L to the reservoir 70.

In an alternative arrangement, the recess 122 and drain passage 124 may be formed in the crankcase member 66. In such an arrangement, the recess would extend beyond an inner surface of the forward wall 66*a* of the crankcase member 66 and the drain passage would extend vertically through the wall 66*a* and, preferably, be spaced from the supports 114.

The cylinder block 62 also includes a plurality of apertures 128 extending vertically through each of the supports 114 and the lower wall of the crankcase chamber 52. Desirably, the apertures 128 are circular in shape and are aligned along a common axis 130, which is vertical in the environment of the outboard motor 36. Preferably, the axis 130 is oriented such that the axis 80 of each cylinder bore 72, 74, 76, 78 intersects the axis 130. The apertures 128 further enhance the evacuation of lubricant from each section of the crankcase chamber 52.

With reference to FIG. 4, desirably, a plug 132 closes the aperture 128 of the lower wall of the cylinder block 62, or the lowermost aperture, and creates a seal to prevent lubricant from leaking from the crankcase chamber 52. Preferably, the plug 132 is secured to the cylinder block 62 by a pair of threaded fasteners, such as bolts 134. Alternatively, other suitable arrangements for securing the plug 132 within the aperture 128 may also be used, such as a press-fit arrangement, for example.

A lubricant drain conduit 136 connects the lowermost aperture 128 and a lubricant return conduit 138. The return conduit 138 delivers lubricant to the lubricant reservoir 70, for repeated circulation by the lubricant pump 68. The illustrated drain conduit 136 is formed within the cylinder block 62 and is inclined with respect to the vertical axis $A_C$ of the crankshaft 50. However, other arrangements of the return conduit 138 are also possible, such as being partially, or wholly, formed by a separate member from the cylinder block 62.

Preferably, the lubricant drain arrangement additionally includes a lubricant guide channel 140 extending from the lowermost, or fourth, cylinder bore 78 to the drain conduit 136 and/or the lowermost aperture 128. Desirably, the guide channel 140 intersects the cylinder bore 78 at substantially its lowermost point. The guide channel 140 can be declined in the forward direction and, preferably, terminates generally at an intersection of the lowermost aperture 128 and the lubricant drain conduit 136. Thus, the guide channel 140 permits lubricant to be evacuated from the lowermost cylinder bore 78 and at least substantially prevent pooling of lubricant therein.

Figure 1:
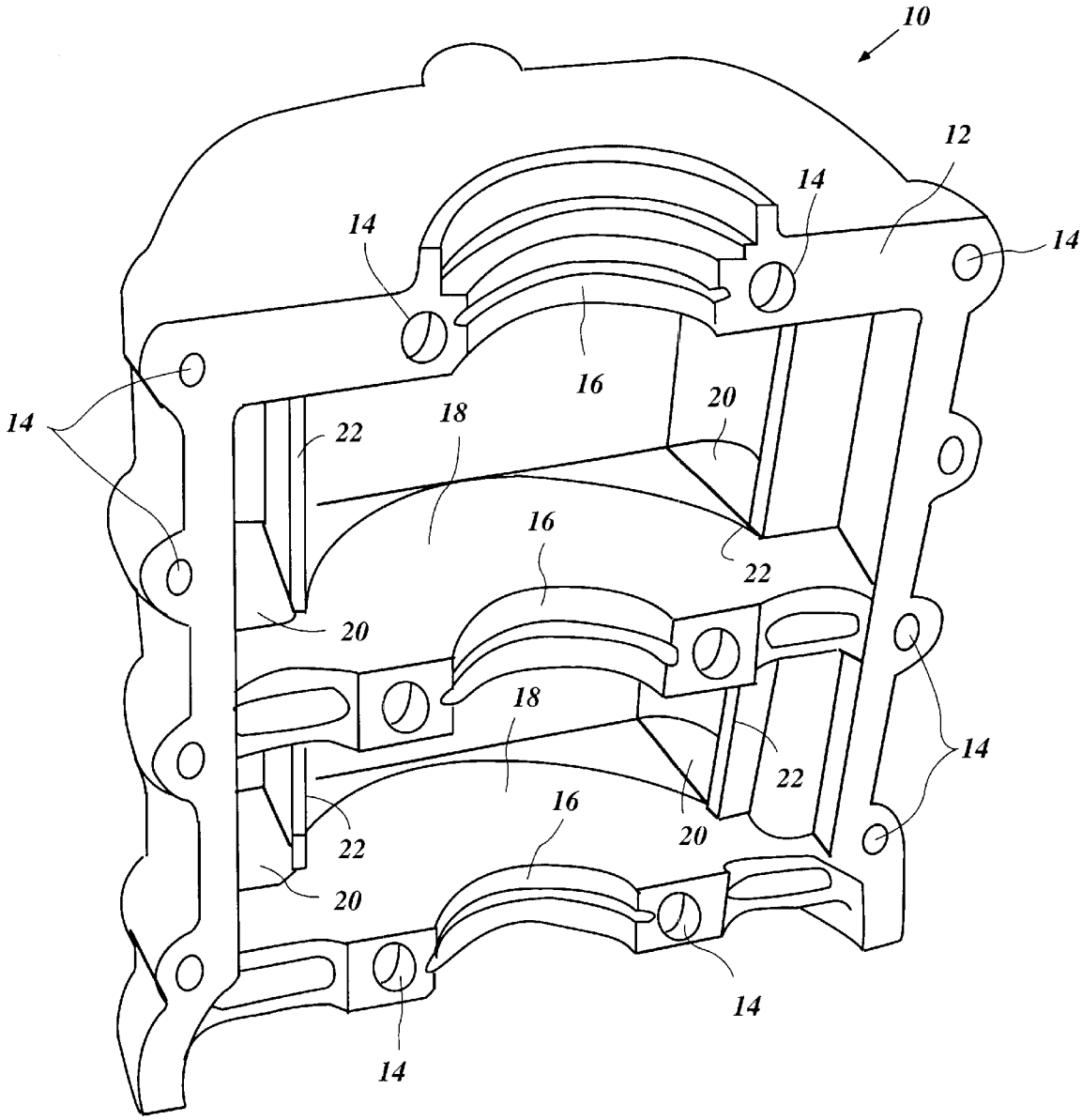
Figure 1 Prior Art
FIG. 1 is a rear, top, and port side view of a prior art crankcase member.

The preferred embodiment of the lubricant drain arrangement described herein provides a number of advantages over prior arrangements. For example, the recessed arrangement of the lubricant drain passage 124 permits the omission of thin-walled supports, or ribs, positioned adjacent the drain passage, which cause pooling of lubricant within the crankcase, as described above in relation to the prior art construction illustrated in FIG. 1.

Furthermore, if the recess 122 and drain passage 124 are provided in the cylinder block 62, rather than the crankcase member 66, the strength of the crankshaft supports 114 of the crankcase member 66 can be increased due to the absence of passages therethrough to allow draining of lubricant. As discussed above in relation to the prior art arrangement of FIG. 1, the bearing supports 18 must absorb the load applied to the crankshaft due to combustion within the combustion chambers of the engine. As noted, the provision of passages through the supports 18 compromises the strength and rigidity of the crankcase member 10. In addition, spacing the drain passage 124 from the supports 114 (i.e., a vertical groove in the cylinder block 62) further increases the strength and rigidity of the supports 114.

In a preferred embodiment, a tangent line between the recess 122 and/or drain passage 124 and the outer surface of the crankshaft throws 85 is unobstructed and, desirably, generally parallel to the cylinder axis 80. Accordingly, lubricant flung from the crankshaft 50, along the tangent line, readily enters the recess 122 and, thus, the drain passage 124.

Similarly, the provision of the apertures 128 within the supports 114 of the cylinder block 62, rather than those of the crankcase member 66, permits additional drainage of lubricant from each section of the crankcase chamber 52, without compromising the strength of the crankcase member 66. In addition, because the apertures 128 are aligned along a common axis 130 and include an aperture 128 through the lowermost wall of the cylinder block 62, manufacturing of the lubricant drain arrangement is simplified. For example, the apertures 128 may be created by a single cutting tool passing through the lowermost wall of the cylinder block 62, which is then closed with the plug 132.

Of course, the foregoing description is that of certain features, aspects and advantages of the present invention to which various changes and modifications may be made without departing from the spirit and scope of the present invention. Moreover, an outboard motor may not feature all objects and advantages discussed above and still fall within the scope of the present invention. Thus, for example, those skilled in the art will recognize that the invention may be embodied or carried out in a manner that achieves or optimizes one advantage or group of advantages as taught herein without necessarily achieving other objects or advantages as may be taught or suggested herein. In addition, modifications and alternate constructions from that discussed above are possible, which are fully equivalent to the present invention. The present invention, therefore, should only be defined by the appended claims.

What is claimed is:

1. An outboard motor comprising an internal combustion engine and a propulsion device, a lubrication system configured to deliver lubricant to a portion of the engine, the engine having a crankshaft arranged in a generally vertical manner, a drive shaft connecting the crankshaft to the propulsion device, the engine including a cylinder block and a crankcase, the cylinder block defining a plurality of cylinder bores, each cylinder bore defining a generally horizontal axis and being spaced from one another in a vertical direction, the cylinder block having a first wall generally aligned with a first end of the cylinder bores nearest the crankshaft, a cylinder skirt extending generally from a periphery of the first wall and terminating in a first mating surface, the crankcase including a second wall, a second mating surface, a peripheral wall extending between the second wall and the second mating surface, the cylinder block and the crankcase being assembled such that the first mating surface faces the second mating surface, the cylinder block and the crankcase defining a crankcase chamber therebetween, a plurality of support members extending from the first wall and the second wall in a paired configuration and terminating in cooperating bearing surfaces to rotatably supporting the crankshaft, a recess defined by one of the cylinder block and the crankcase and extending beyond one of the first wall and the second wall away from the crankcase chamber, an oil drain passage communication with the recess and extending in a downward direction past the plurality of support members and through a lower end of one of the cylinder skirt and the peripheral wall.

2. The outboard motor of claim 1, wherein the recess and the oil drain passage are defined by the cylinder block.

3. The outboard motor of claim 1, wherein the crankshaft comprises a main crankshaft portion and a plurality of throw portions, the main crankshaft portion being rotatably supported by the support members, the throw portions defining a diameter larger than a diameter of the main crankshaft portion, a tangent line between the throw portions and the recess being substantially unobstructed to permit lubricant flung from the throw portions, along the tangent line, to enter the oil drain passage through the recess.

4. The outboard motor of claim 3, wherein the tangent line is generally parallel with the axes of the cylinder bores.

5. The outboard motor according to claim 1, wherein the recess comprises a generally vertically extending groove defined in the cylinder block.

6. An outboard motor comprising an internal combustion engine and a propulsion device, a lubrication system configured to deliver lubricant to a portion of the engine, the engine having a crankshaft arranged in a generally vertical manner, a drive shaft connecting the crankshaft to the propulsion device, the engine including a cylinder block and a crankcase, the cylinder block defining a plurality of cylinder bores, each cylinder bore defining a generally horizontal axis and being spaced from one another in a vertical direction, the cylinder block having a first wall generally aligned with a first end of the cylinder bores nearest the crankshaft, a cylinder skirt extending generally from a periphery of the first wall and terminating in a first mating surface, the crankcase including a second wall, a second mating surface, a peripheral wall extending between the second wall and the second mating surface, the cylinder block and the crankcase being assembled such that the first mating surface faces the second mating surface, the cylinder block and the crankcase defining a crankcase chamber therebetween, a plurality of support members extending from the first wall and the second wall in a paired configuration and terminating in cooperating bearing surfaces to rotatably supporting the crankshaft, a plurality of apertures extending through the plurality of support members of the cylinder block and a lower end of the cylinder skirt, the apertures being aligned along a common axis, a plug closing the aperture of the cylinder skirt, an oil guide passage communicating with a lowermost of the cylinder bores and the aperture of the cylinder skirt, an oil drain passage communicating with the oil guide passage and extending through the cylinder block to permit lubricant to evacuate the crankcase chamber.

7. The outboard motor of claim 6, wherein the axis of the apertures generally intersects the axes of the cylinder bores.

8. The outboard motor according to claim 6 additionally comprising a generally vertically extending groove in the first wall of the cylinder block, the groove being configured to allow oil to drain downwardly through the crankcase.

9. An internal combustion engine comprising a lubrication system configured to deliver lubricant to a portion of the engine, the engine having a crankshaft arranged in a generally vertical manner and including an engine body defining a plurality of cylinder bores and a crankcase chamber, each cylinder bore defining a generally horizontal axis and being spaced from one another in a vertical direction, the crankcase chamber having a pair of opposing walls, one of the walls being between the crankshaft and the cylinder bores, a plurality of support members extending from the opposing walls in a paired configuration and terminating in cooperating bearing surfaces to rotatably supporting the crankshaft, a recess defined by the engine body and extending beyond one of the opposing walls away from the crankshaft, the recess defining an oil drain passage extending in a downward direction to a lower end of the engine body.

10. The engine of claim 9, wherein the engine body comprises a cylinder block and a crankcase, the cylinder block and the crankcase cooperating to define the crankcase chamber, the cylinder block defining the plurality of cylinder bores, the recess and the oil drain passage being defined by the cylinder block.

11. The engine of claim 9, wherein the crankshaft comprises a main crankshaft portion and a plurality of throw portions, the main crankshaft portion being rotatably supported by the support members, the throw portions defining a diameter larger the a diameter of the main crankshaft portion, a tangent line between the throw portions and the recess being substantially unobstructed to permit lubricant flung from the throws, along the tangent line, to enter the oil drain passage through the recess.

12. The engine of claim 11, wherein the tangent line is generally parallel with the axes of the cylinder bores.

13. The engine of claim 9, wherein the recess comprises a generally vertically extending groove defined in the crankcase.

14. An internal combustion engine comprising a lubrication system configured to deliver lubricant to a portion of the engine, the engine having a crankshaft defining a generally vertical crankshaft axis and including an engine body defining a plurality of cylinder bores and a crankcase chamber, each cylinder bore defining a generally horizontal axis and being spaced from one another in a vertical direction, the crankcase chamber having a pair of opposing walls, one of the walls being between the crankshaft and the cylinder bores, a plurality of support members extending from the opposing walls in a paired configuration and terminating in cooperating bearing surfaces to rotatably supporting the crankshaft, a plurality of apertures extending through the plurality of support members between the crankshaft and the cylinder bores and a lower end of the engine body, the apertures being aligned along a common axis, a plug closing the aperture of the engine body, an oil drain arrangement communicating with a lowermost of the cylinder bores and the aperture of the engine body, the oil drain arrangement extending through the engine body to permit lubricant to evacuate the crankcase chamber.

15. The engine of claim 14, wherein said oil drain arrangement comprises an oil guide passage communicating with the lowermost cylinder bore and the aperture of the engine body and an oil drain passage communicating with the oil guide passage and extending through the engine body.

16. The engine of claim 14, wherein the axis of the apertures generally intersects the axes of the cylinder bores.

17. The engine of claim 14 additionally comprising a generally vertically extending groove defined in the cylinder block and configured to allow oil to drain downwardly through the crankcase.

* * * * *